US009540147B2

(12) United States Patent
Song

(10) Patent No.: US 9,540,147 B2
(45) Date of Patent: Jan. 10, 2017

(54) ZIPPER ASSEMBLY AND FRESH-KEEPING BAG PROVIDED WITH THE SAME

(71) Applicant: Zhixuan Song, Yantai (CN)

(72) Inventor: Zhixuan Song, Yantai (CN)

(73) Assignee: YANTAI LONGQUAN PLASTIC AND RUBBER PRODUCTS CO., LTD, Shandong (CN)

( * ) Notice: Subject to any disclaimer, the term of this patent is extended or adjusted under 35 U.S.C. 154(b) by 0 days.

(21) Appl. No.: 14/348,002

(22) PCT Filed: Nov. 6, 2012

(86) PCT No.: PCT/CN2012/084145

§ 371 (c)(1),
(2) Date: Mar. 27, 2014

(87) PCT Pub. No.: WO2014/067170

PCT Pub. Date: May 8, 2014

(65) Prior Publication Data

US 2015/0314923 A1 Nov. 5, 2015

(30) Foreign Application Priority Data

Nov. 2, 2012 (CN) ..... 2012 1 0433460

(51) Int. Cl.
*A44B 19/26* (2006.01)
*B65D 33/25* (2006.01)

(52) U.S. Cl.
CPC ..... *B65D 33/2591* (2013.01); *A44B 19/26* (2013.01); *Y10T 24/158* (2015.01)

(58) Field of Classification Search
CPC ... A44B 19/26; Y10T 24/158; Y10T 24/2507; Y10T 24/2532; Y10T 24/258; Y10T 24/2582; B65D 33/2591
See application file for complete search history.

(56) References Cited

U.S. PATENT DOCUMENTS 5,301,394 A * 4/1994 Richardson ..... B65D 33/2591 24/399

FOREIGN PATENT DOCUMENTS

WO WO2006040777 A1 * 4/2006 ..... B65D 33/2591

* cited by examiner

*Primary Examiner* — Jack W Lavinder
(74) *Attorney, Agent, or Firm* — Symbus Law Group LLC; Clifford D. Hyra

(57) ABSTRACT

A fresh-keeping bag is provided with a zipper assembly including a slider and a zipper. The slider comprises two limiting pieces arranged in parallel and each provided with two limiting blocks, one connecting block, and an opening tongue located between the two limiting pieces and connected with the connecting block. The zipper comprises two single-chains, each provided with two toothless hooks arranged in parallel and respectively arranged on the two single-chains to cooperate with each other one to one; one of the two toothless hooks on each single-chain is provided with an auxiliary track on one side thereof; and the auxiliary tracks respectively arranged on the two single-chains are disposed oppositely The opening tongue props open the toothless hooks indirectly, eliminating the possibility of moisture flowing out between the opening tongue and the toothless hooks. Fresh-keeping bags applied with such zipper assembly prevent moisture from flowing out from the opening.

8 Claims, 3 Drawing Sheets

ZIPPER ASSEMBLY AND FRESH-KEEPING BAG PROVIDED WITH THE SAME

This application claims the benefit of Chinese patent application No. 201210433460.4, filed Nov. 2, 2012, which is hereby incorporated by reference in its entirety.

TECHNICAL FIELD

This invention relates to the field of goods packaging, in particular it relates to a zipper assembly and a fresh-keeping bag (preservation bag) provided with such zipper assembly.

BACKGROUND ART

A zipper assembly is a closure device commonly used in daily life, and it is composed of two chains and a slider. When the slider slips along the two chains towards one direction, the two chains will be dosed together, and when the slider slips towards the opposite direction, the two chains will be separated, thus forming a passable opening between the two chains.

Since the opening and closing of the zipper assembly is very convenient, it has now been widely used in fresh-keeping bags. Fresh-keeping bags are generally used for holding food. Some food itself contains moisture, and if the moisture (water) outflows from the fresh-keeping bag, it will pollute the refrigerator or other food. In order to prevent this situation from happening, the bag body of most existing fresh-keeping bags is made of plastic material with good waterproof performance, which can however only prevent the moisture from flowing out from the bag body, and cannot prevent the moisture from flowing out the opening. In the existing zipper assembly, in order to make the slider open or dose the zipper, an opening tongue extends generally between the non-toothed hooks on the two chains. However, with such an arrangement, complete sealing fans to be achieved between the opening tongue and the non-toothed hooks, and moisture will flow out from the gap between the opening tongue and non-toothed hooks. Therefore, such zipper assembly does not have waterproof ability, and cannot prevent the moisture from flowing out the opening.

DISCLOSURE OF THE INVENTION

The invention provides a zipper assembly.

The invention also provides a fresh-keeping bag provided with the zipper assembly.

The zipper assembly and the fresh-keeping bag provided with the zipper assembly of the invention can prevent moisture from flowing out the opening where the zipper assembly is located.

In order to achieve the above purposes, the technical solutions of the invention are realized as follows.

A zipper assembly includes a slider and a zipper.

The slider comprises an opening tongue, two limiting pieces and one connecting block, wherein the two limiting pieces are arranged in parallel; the opening tongue is located between the two limiting pieces and is connected with the connecting block; each of the two limiting pieces is provided with two limiting blocks at the side away from the connecting block, the limiting blocks respectively arranged on the two limiting pieces are disposed oppositely in a one-to-one relationship, and the spacing between the two limiting blocks provided on the same limiting piece is larger than the length of the opening tongue in the direction where the spacing is located.

The zipper comprises two single-chains; each single-chain is provided with two toothless hooks arranged in parallel; the toothless hooks respectively arranged on the two single-chains one to one cooperate with each other; one of the two toothless hooks on each single-chain is provided with one auxiliary track on one side; the auxiliary tracks respectively arranged on the two single-chains are disposed oppositely.

When the slider cooperates with the zipper, the two single-chains go through the area enclosed by the two limiting pieces, the four limiting blocks and the connecting block; the opening tongue is located in a cavity enclosed by the two auxiliary tracks and the two toothless hooks adjacent to them.

Further, in the above mentioned zipper assembly, when the two single-chains cooperate with each other, the spacing between the internal sides of the cavity is smaller than the spacing between the joints where the two toothless hooks and the single-chains join respectively, and the spacing between the external sides of the cavity is smaller than the spacing between the external walls to which the joints between the two toothless hooks and the two single-chains correspond respectively.

Further, in the above mentioned zipper assembly, the hooks of the two toothless hooks located on the same single-chain face the same direction; each single-chain is provided with a hook limiting strip, which is arranged on the side to which the hooks of the two toothless hooks face.

Further, in the above mentioned zipper assembly, each single-chain is provided with a slider limiting strip at the side away from the auxiliary track, and the projecting direction of the slider limiting strip is opposite to the direction of the toothless hooks.

Further, in the above mentioned zipper assembly, when the two single-chains cooperate, the spacing between the external skies of the two single-chains at the side away from the auxiliary tracks is smaller than the spacing between the external walls to which the joints between the two toothless hooks and the two single-chains correspond respectively.

Further, in the above mentioned zipper assembly, the dimension of the opening tongue in the direction where the spacing between the two limiting pieces is located is tapered in the direction where the spacing between the two limiting blocks on the same limiting piece are located.

Further, in the above mentioned zipper assembly, a combing strip is respectively provided on each of the two limiting pieces, the extending direction of the combing strips is perpendicular to the length direction of the opening tongue; the two combing strips are arranged oppositely and located at the end of the opening tongue having smaller width.

Further, in the above mentioned zipper assembly, a chamfer bevel is provided on the side of each limiting block away from the limiting piece connecting with it; the chamfer bevels on the opposite limiting blocks are arranged oppositely; and all the chamfer bevels are located at the side to which the end of the opening tongue having smaller width directs.

Further, in the above mentioned zipper assembly, anti-slip wrinkles are provided on the side where the two limiting pieces are away from each other, the length direction of the anti-slip wrinkles is perpendicular to the length direction of the opening tongue.

A fresh-keeping bag includes a bag body, and the bag body is provided with an opening which is provided with any of the above mentioned zipper assemblies.

Compared with the prior art, the zipper assembly of the invention is provided with two toothless hooks on each single-chain. Since the toothless hook is an integral one with no gap, it can fulfill an excellent waterproof function, and a completely waterproof effect can be substantially achieved by arranging two toothless hooks. By providing the auxiliary tracks, the opening tongue can be arranged in the cavity enclosed by the auxiliary tracks and the toothless hooks, and the opening tongue props open the toothless hooks indirectly, while the opening tongue itself does not insert between the toothless hooks. Since the possibility of the moisture flowing out from the gap between the opening tongue and the toothless hooks is eliminated, the waterproof purpose is achieved. The fresh-keeping bags applied with such zipper assembly can prevent moisture from flowing out the opening of the fresh-keeping bags.

In addition, the zipper assembly provided by the invention also has the following technical effects.

(1) It can be easier for the opening tongue to prop open the toothless hooks by making the spacing between the internal sides of the cavity smaller than the spacing between the joints where the two toothless hooks and the single-chains join respectively and by making the spacing of the external sides of the cavity smaller than the spacing between the external walls to which the joints between the two toothless hooks and the two single-chains correspond respectively.

(2) By providing the hook limiting strip, the toothless hooks on the two single-chains can cooperate more closely, while having waterproof effects to a certain extent.

(3) The provision of the slider limiting strip can ensure the position relationship between the slider and the zipper, preventing the zipper from being damaged due to excessive extrusion from the slider.

(4) The limiting block can be locked there, preventing the slider from disengaging from the zipper, by making the spacing between external sides of the two single-chains at the side away from the auxiliary tracks smaller than the spacing between the external walls to which the joints between the two toothless hooks and the two single-chains correspond respectively.

(5) The resistance encountered by the slider can be reduced when dosing, with more labor saving, by making the dimension of the opening tongue in the direction where the spacing between the two limiting pieces are located taper in the direction where the spacing between the two limiting blocks provided on the same limiting piece are located.

(6) The provision of the combing strips can comb the single-chains, making the distorted location of it smooth, which is convenient for the slider going through.

(7) The provision of the chamfer bevel can make the zipper more easily go into the inside of the slider.

(8) The provision of the anti-slip wrinkles can increase the surface friction of the slider, making it easier to be used by people.

BRIEF DESCRIPTION OF DRAWINGS in order to illustrate more clearly the specific embodiments of the invention or the technical solutions in the prior art, a brief introduction on the drawings referred to in the embodiments or the existing technical description is as follows. Obviously, these drawings below illustrate some embodiments of the present invention. For those ordinary skilled persons in this field, other drawings can also be obtained according to these drawings without creative work.

Reference numbers: 1—opening tongue, 2—limiting piece, 3—connecting block, 4—limiting block, 5—single-chain, 6—toothless hook, 7—auxiliary track, 8—cavity, 9—hook limiting strip, 10—slider limiting strip, 11—combing strip, 12—chamfer bevel, 13—anti-slip wrinkle.

DETAILED DESCRIPTION OF EMBODIMENTS OF THE INVENTION

In order to make the purposes, technical solutions and advantages of the present invention more clear, clear and complete description will be made of the technical solution of the present invention in the following. Based on the specific embodiments of the present invention, all the other embodiments obtained by those skilled in the art without creative work fall within the protection scope of the present invention.

Figure 1:
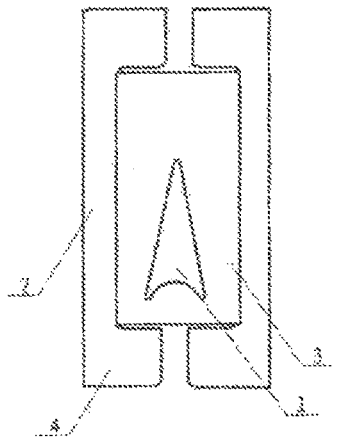
FIG. 1 is a schematic diagram of the overall structure of a slider according to the first embodiment of the invention.
Figure 2:
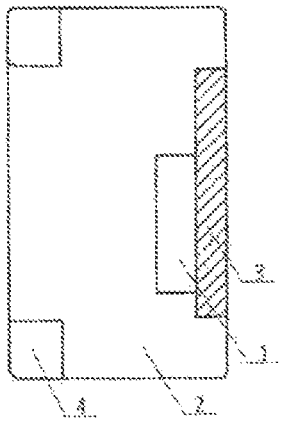
FIG. 2 is a side sectional schematic diagram of the slider according to the first embodiment of the invention.
Figure 3:
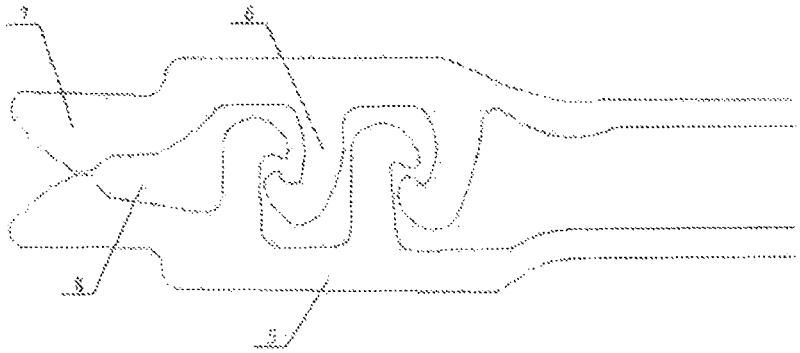
FIG. 3 is a schematic sectional view of a zipper according to the first embodiment of the invention.

The first embodiment of the invention provides a zipper assembly, as shown in FIGS. 1 to 3, including a slider and a zipper.

The slider comprises an opening tongue 1, two limiting pieces 2 and one connecting block 3 wherein the two limiting pieces 2 are arranged in parallel; the opening tongue 1 is located between the two limiting pieces 2 and is connected with the connecting block 3; each of the two limiting pieces 2 is provided with two limiting blocks 4 at the side away from the connecting block 3, the limiting blocks 4 respectively arranged on the two limiting pieces 2 are disposed oppositely in a one-to-one relationship, and the spacing between the two limiting blocks 4 provided on the same limiting piece 2 is larger than the length of the opening tongue 1 in the direction where the spacing is located.

The zipper comprises two single-chains 5; each single-chain 5 is provided with two toothless hooks 6 arranged in parallel; the toothless hooks 6 respectively arranged on the two single-chains 5 cooperate with each other one to one; one of the two toothless hooks 6 on each single-chain 5 is provided with an auxiliary track 7 on one side thereof; the auxiliary tracks 7 respectively arranged on the two single-chains 5 are disposed oppositely.

When the slider cooperates with the zipper, the two single-chains 5 go through the area enclosed by the two limiting pieces 2, the four limiting blocks 4 and the connecting block 3; the opening tongue 1 is located in a cavity 8 enclosed by the two auxiliary tracks 7 and the two toothless hooks 6 adjacent to them.

By arranging two toothless hooks 6 on each single-chain 5, since the toothless hook 6 is an integral one with no gap, which therefore can fulfill an excellent waterproof function, completely waterproofing can be basically achieved by arranging two toothless hooks at the same time. By providing the auxiliary tracks 7, the opening tongue 1 can be arranged in the cavity 8 enclosed by the auxiliary tracks 7 and the toothless hooks, and the opening tongue 1 props open the toothless hooks 6 indirectly, but the opening tongue 1 itself does not insert between the toothless hooks 6, thus eliminating the possibility of moisture flowing out from the gap between the opening tongue 1 and the toothless hooks 6, achieving the waterproof purpose. Fresh-keeping bags applied with such zipper assembly can prevent moisture from flowing out the opening of the fresh-keeping bags.

Figure 4:
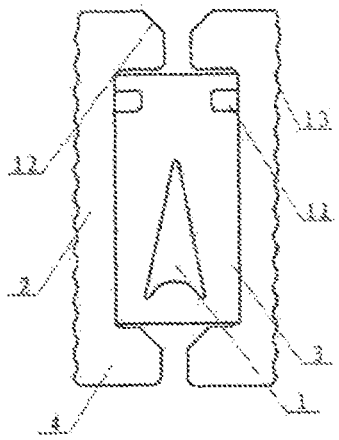
FIG. 4 is a schematic diagram of the overall structure of a slider according to the second embodiment of the invention.
Figure 5:
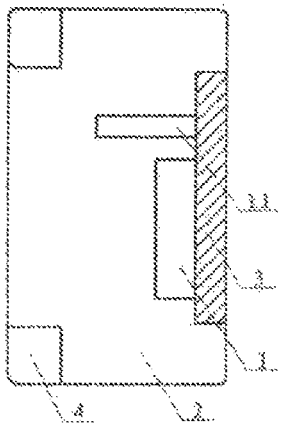
FIG. 5 is a side sectional schematic diagram of the slider according to the second embodiment of the invention.
Figure 6:
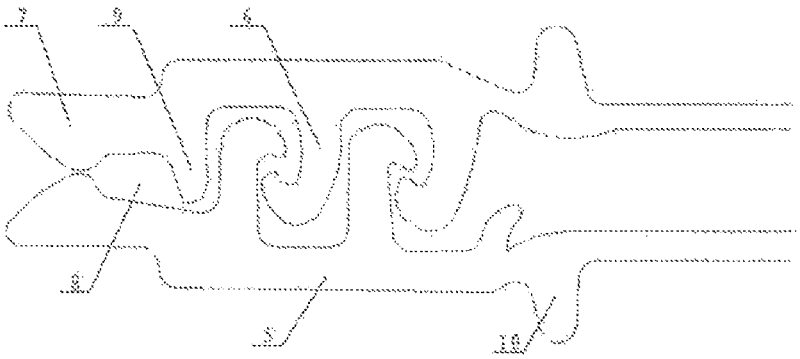
FIG. 6 is a schematic sectional view of a zipper according to the second embodiment of the invention.

In order to further enhance the performance of the zipper assembly, the second embodiment of the invention provides an improved zipper assembly, as shown in FIGS. 4 and 6, including a slider and a zipper.

The slider comprises an opening tongue 1, two limiting pieces 2 and one connecting block 3, wherein the two limiting pieces 2 are arranged in parallel; the opening tongue 1 is located between the two limiting pieces 2 and is connected with the connecting block 3; each of the two limiting pieces 2 is provided with two limiting blocks 4 at the side away from the connecting block 3, the limiting blocks 4 respectively arranged on the two limiting pieces 2 are disposed oppositely in a one-to-one relationship, and the spacing between the two limiting blocks 4 provided on the same limiting piece 2 is larger than the length of the opening tongue 1 in the direction where the spacing is located.

The zipper comprises two single-chains 5; each single-chain 5 is provided with two toothless hooks 6 arranged in parallel; the toothless hooks 6 respectively arranged on the two single-chains 5 cooperate with each other one to one; one of the two toothless hooks 6 on each single-chain 5 is provided with an auxiliary track 7 on one side thereof; the auxiliary tracks 7 respectively arranged on the two single-chains 5 are disposed oppositely.

When the slider cooperates with the zipper, the two single-chains 5 go through the area enclosed by the two limiting pieces 2, the four limiting blocks 4 and the connecting block 3; the opening tongue 1 is located in a cavity 8 enclosed by the two auxiliary tracks 7 and the two toothless hooks 6 adjacent to them.

When the two single-chains 5 cooperate with each other, the inner spacing of the cavity 8 is smaller than the spacing between the joints where the two toothless hooks 6 and the single-chains 5 join respectively, and the spacing between the outsides of the cavity 8 is smaller than the spacing between the outer wads to which the joints between the two toothless hooks 6 and the two single-chains 5 correspond respectively. Since the spacing within the cavity 8 is small, a strong force can be produced on the inner walls of the cavity 8 by the opening tongue even though the opening tongue 1 is small in size, and since the spacing between the outsides of the cavity 8 is smaller than the spacing between the outer walls to which the joints between the two toothless hooks 6 and the two single-chains 5 correspond respectively, the force will be better transferred to the toothless hooks 6, such that the toothless hooks 6 on both sides separate, completing the opening of the zipper.

If it only depends on interaction between the two toothless hooks 6, deformation may appear in the toothless hooks 6 after long-time use, resulting in incapability of normal coupling. In order to avoid this situation, the hooks of the two toothless hooks 6 located on the same single-chain 5 face the same direction; each single-chain 5 is provided with a hook limiting strip 9 which is arranged on the side to which the hooks of the two toothless hooks 6 face. Thus the toothless hooks 6 can be restricted, effectively preventing their deformation, and the toothless hooks 6 on the two single-chains 5 can cooperate more closely, while having waterproof effects to a certain extent.

The slider covers the zipper when in cooperation. If it covers too tightly, the zipper may deform due to the extrusion from the slider, thereby affecting its performance. In order to avoid the above mentioned situation, each single-chain 5 may be provided with a slider limiting strip 10 at the side away from the auxiliary track 7, the projecting direction of slider limiting strip is opposite to the direction of the toothless hooks 6. Thus the slider limiting strip can lock the limiting piece 2, ensuring the position relationship between the slider and the zipper, preventing the zipper from being damaged due to too much extrusion from the slider.

When the slider and the zipper cooperate with each other, the limiting block 4 mainly performs combing and locking functions, but its locking function generally relies on friction force and clamping force, thus preventing the slider from disengaging from the zipper. However if the friction force or clamping force is too large, it will lead the slider to be difficult to slide, causing inconvenience in use. In order to solve the above problem, the space between the sides of the two single-chains 5 away from the auxiliary tracks 7 is smaller than the spacing between the outer was to which the joints between the two toothless hooks 6 and the two single-chains 5 correspond respectively, when the two single-chains 5 cooperate. Thus, the limiting block 4 can be locked here, preventing the slider from disengaging from the zipper.

In addition, the dimension of the opening tongue 1 in the direction where the spacing of the two limiting pieces 2 is located may be provided as being tapered in the direction where the spacing between the two limiting blocks 4 on the same limiting piece 2 is located. Such that the resistance, which is encountered by the slider when dosing, is reduced, saving more labor while having a better combing effect.

The limiting block 4 generally combs only the portion of the zipper contacting therewith, but the combing function is limited for other portions of the zipper, especially for the portion of the zipper in the area between the limiting block 4 and the connecting block 3. And since the portion of the zipper in this area is at the same time affected by the limiting block 4, the connecting block 3 and the opening tongue 1 together, its shape is easy to distort, blocking the slider from normal sliding. In order to avoid the above mentioned problem, a combing strip 11 may be respectively provided on each of the two limiting pieces 2, the extending direction of the combing strips 11 is perpendicular to the length direction of the opening tongue 1; the two combing strips 11 are arranged oppositely and are located at the end of the opening tongue 1 having smaller width. Thus the zipper can be combed, making the distorted location smooth, which is convenient for the slider going through.

In order to facilitate the zipper going through the gap between the two opposite limiting blocks 4, preferably a chamfer bevel 12 is provided on the side of each limiting block 4 away from the limiting piece 2 connecting with it; the chamfer bevels 12 on the opposite limiting blocks 4 are arranged oppositely; and all the chamfer bevels 12 located at the side to which the end of the opening tongue 1 having smaller width directs, such that the zipper goes more easily into the inside of the slider.

During use, an external force is usually applied on the limiting piece 2, making the slider slide, but if the surface of the slider is too smooth, the users must apply a very large force to push the slider. In order to avoid the above mentioned situation, anti-slip wrinkles 13 may be provided on the side where the two limiting pieces 2 are away from each other, the length direction of the anti-slip wrinkles is perpendicular to the length direction of the opening tongue 1, which can increase the surface friction of the slider, making it easier to be used by people.

Finally, it is to be explained that the above embodiments and examples are merely to illustrate the technical solutions of the invention, rather than limiting the invention. While detailed description is made to the present invention with reference to the above mentioned embodiments and examples, those ordinary skilled persons in the field should understand that the technical solutions of the above mentioned embodiments or examples can be modified, or equivalent substitutions can be made to some technical features; and with these modifications or substitutions, the essence of the corresponding technological solutions does not depart from the spirit and scope of the technical solutions of the embodiments or examples of the invention.

What is claimed is:

1. A zipper assembly including a slider and a zipper;

wherein the slider comprises an opening tongue, two limiting pieces and one connecting block; the two limiting pieces are arranged in parallel; the opening tongue is located between the two limiting pieces and is connected with the connecting block; each of the two limiting pieces is provided with two limiting blocks at a side away from the connecting block, the limiting blocks respectively arranged on the two limiting pieces are disposed oppositely in one-to-one relationship, and a spacing between the two limiting blocks provided on a same limiting piece is larger than a length of the opening tongue in a direction where the spacing is located;

the zipper comprises two single-chains; each single-chain is provided with two toothless hooks arranged in parallel; the toothless hooks respectively arranged on the two single-chains cooperate with each other; one of the two toothless hooks on each single-chain is provided with one auxiliary track on one side thereof; the auxiliary tracks respectively arranged on the two single-chains are disposed oppositely;

when the slider cooperates with the zipper, the two single-chains go through an area enclosed by the two limiting pieces, the four limiting blocks and the connecting block; and the opening tongue is located in a cavity enclosed by the two auxiliary tracks and the two toothless hooks adjacent to them, and the opening tongue props open the toothless hooks indirectly, but the opening tongue itself does not insert between the toothless hooks;

the two toothless hooks, located on a same single-chain, face a same side of the zipper; and each single-chain is provided with a hook limiting strip which is arranged on the side to which the hooks of the two toothless hooks face; and one combing strip is respectively provided on each of the two limiting pieces, extending perpendicular to a length of the opening tongue; and the two combing strips are arranged oppositely and located at a narrower end of the opening tongue.

2. The zipper assembly according to claim 1 characterized in that when the two single-chains cooperate with each other, a spacing between internal sides of the cavity is smaller than a spacing between joints where the two toothless hooks and the single-chains join respectively, and a spacing between the external sides of the cavity is smaller than a spacing between external walls to which the joints between the two toothless hooks and the two single-chains correspond respectively.

3. The zipper assembly according to claim 1 characterized in that each single-chain is provided with a slider limiting strip at the side away from the auxiliary track, and a projecting direction of the slider limiting strip is opposite to a direction of the toothless hooks.

4. The zipper assembly according to claim 1 characterized in that when the two single-chains cooperate, a spacing between external sides of the two single-chains at a side away from the auxiliary tracks is smaller than a spacing between external walls to which the joints between the two toothless hooks and the two single-chains correspond respectively.

5. The zipper assembly according to claim 1 characterized in that a dimension of the opening tongue in a direction where a spacing of the two limiting pieces locates is tapered in a direction where a spacing between the two limiting blocks provided on a same limiting piece locates.

6. The zipper assembly according to claim 5 characterized in that a chamfer bevel is provided on a side of each limiting block away from the limiting piece connecting with it; the chamfer bevels on opposite limiting blocks are arranged oppositely; and all the chamfer bevels locate at a side to which an end of the opening tongue having smaller width directs.

7. The zipper assembly according to claim 1 characterized in that anti-slip wrinkles are provided on sides of the two limiting pieces where the two limiting pieces are away from each other, and a length direction of the anti-slip wrinkles is perpendicular to a length direction of the opening tongue.

8. A fresh-keeping bag including a bag body, wherein the bag body is provided with an opening which is provided with the zipper assembly according to claim 1.

* * * * *